United States Patent [19]

Trumble et al.

[11] 4,033,323

[45] July 5, 1977

[54] HEAT TRANSFER SLEEVE FOR CHEMICAL HEATERS

[75] Inventors: John H. Trumble, Elm Grove; Akos Szekely, Colgate, both of Wis.

[73] Assignee: Thermology, Inc., Milwaukee, Wis.

[22] Filed: June 16, 1975

[21] Appl. No.: 586,905

[52] U.S. Cl. ..... 126/263; 126/390

[51] Int. Cl.[2] ..... F24J 1/02

[58] Field of Search ..... 126/263, 390, 367, 227, 126/230, 226; 165/183, 185, 179, 182; 102/39; 44/38, 40; 252/70; 149/15, 16, 37, 44

[56] References Cited

UNITED STATES PATENTS

| | | | |
|---|---|---|---|
| 1,060,265 | 4/1913 | Lamb | 219/258 |
| 2,589,509 | 3/1952 | Petragua | 126/263 |
| 2,624,332 | 1/1953 | Lang | 126/263 |
| 2,935,549 | 5/1960 | Woods | 165/185 |
| 3,564,308 | 2/1971 | Ryan | 165/135 |

*Primary Examiner*—John J. Camby
*Assistant Examiner*—Larry I. Schwartz

[57] ABSTRACT

A self-contained heating device useful for a variety of heating applications is disclosed. In a preferred form the device comprises a hermetically sealed cartridge, containing a chemical mixture which produces heat but substantially no gas upon ignition, disposed in a heating unit which also includes a means for igniting the cartridge and a heat transfer sleeve surrounding the cartridge. The sleeve is constructed for optimizing heat transfer from the cartridge and includes in one embodiment a plurality of internal ridges which support the cartridge and define, together with the cartridge and the body of the sleeve, a plurality of air spaces. In a second embodiment a tubular aluminum oxide liner is provided for the sleeve and in still a third embodiment a coated or uncoated screen liner. These sleeve designs retard the rate of heat conduction from the cartridge to the sleeve body, reduce the external temperature of the sleeve and eliminate local hot spots on the sleeve which could cause burning or scorching of the substance being heated.

6 Claims, 8 Drawing Figures

HEAT TRANSFER SLEEVE FOR CHEMICAL HEATERS

BACKGROUND OF THE INVENTION

The present invention relates generally to the art of self-contained heating units and in particular to heating units which employ a chemical reaction to produce heat. Several such heating units are disclosed in the prior art for such diverse heating applications as warming foods or drinks, heating shaving water, heating hair curlers, providing concentrated heat for small soldering jobs, etc. A description of several such prior art units can be found in a copending U.S. Pat. application, Ser. No. 545,206, filed Jan. 29, 1975 now abandoned by John H. Trumble, Dr. Thomas C. Ehlert and Akos Szekely, entitled "Heating Device," which application is assigned to the assignee of the present invention and is expressly incorporated herein by this reference. As disclosed in such copending application, the prior art systems suffered from one or more disadvantages including toxicity of the chemicals, lack of the ability to control the reaction rate and heat output, ignition problems, excessive gas pressures in the heating cartridges, etc.

The co-pending application also discloses that several such prior art devices have employed the "Thermite" reaction for producing heat. This reaction can be represented by either of the following formulas:

$$2Al + Fe_2O_3 \rightarrow 2\ Fe + Al_2O_3 + \text{heat}$$
$$8Al + 3Fe_3O_4 \rightarrow 9\ Fe + 4\ Al_2O_3 + \text{heat}$$

This reaction has received much attention because the iron oxide supplies the reaction supporting oxygen for the system, so the reaction needs no outside gas source and produces no gaseous products. However, as disclosed in the co-pending application, the prior art thermite heaters are impractical in that the reaction rate in such systems is so fast that the available heat cannot be transferred from the heat source to the substance to be heated without boiling, burning or scorching it.

The copending application relates to an invention which comprises thermally and/or chemically controlling the reaction burn rate of such chemical heaater cartridges, and is based on the discovery that the burn time of such cartridges is dependent not only on the chemical mixture, but on the temperature and heat conductivity characteristics of the cartridge shell, the sleeve surrounding the cartridge and the substance being heated. Thermal control is accomplished by dividing the chemical mixture into a plurality of compartments and causing a series reaction through the compartments to extend the reaction time or by providing a plug of inert material at the core of the reactive chemicals. Chemical control is accomplished by adjusting the reaction stoichiometry or by adding diluents to the chemical mixture. Either or both of these techniques has been found to be effective in maximizing heat transfer, especially to liquids and semi-solid food products.

While the invention disclosed in the aforementioned application permits preparation of self-contained heating units which are useful and which possess numerous advantages over prior art heaters, ways of improving the efficiency of heat transfer have been investigated. When employing a metallic cylindrical sleeve snugly surrounding a cartridge containing alumino-thermic reactive chemicals, the sleeve rapidly transfers the heat generated within the cartridge to the external surface of the sleeve, and it has been found that the external sleeve temperature exceeds the scorching temperature of some liquids, especially milk or milk-based food products. This is the case even when using sleeves having external fins such as the sleeve disclosed in the drawings of the aforesaid application. Moreover, the heat is not evenly distributed over the entire surface of the sleeve because, as the chemical reaction progresses through the length of the heating cartridge, temperature measurements have established that the sleeve is hottest at the area thereof adjoining that portion of chemicals then reacting in the cartridge. This hot spot moves down the sleeve until the reaction is completed. It has also been determined that the problem is most pronounced at the middle portion of the sleeve. A sleeve design which overcomes these problems would be a significant advance in this technology.

OBJECTS OF THE INVENTION

It is a primary object of the present invention to provide a sleeve for heaters which allows efficient transfer of heat produced within the sleeve to the substance being heated.

Another object of the present invention is to provide an improved sleeve for chemical heaters of the type employing the alumino-thermic reaction as the heat source.

A further object of the present invention is to provide a sleeve for heaters which is constructed for even heat distribution over the external surface of the sleeve.

Yet another object of the present invention is to provide a sleeve for heaters which minimizes the tendency for heat to build up at the middle of the sleeve.

How these and other objects of the present invention are accomplished will be described in the following specification taken in conjunction with the FIGS. Generally, however, the invention comprises providing a heating device consisting of a cartridge ignition means, a hermetically sealed cartridge containing a quantity of reactive chemical materials and a sleeve for containing the cartridge and distributing heat therefrom. In one preferred form, the sleeve includes a plurality of heat exchange fins on its exterior surface and a plurality of ridges along its internal surface which, together with the cartridge and the body of the sleeve, define a plurality of air spaces. The ridges transfer heat directly to the body of the sleeve while the air spaces retard the rate of heat conduction. In a more specific form of this embodiment the ridges may be interrupted in the vicinity of the middle of the sleeve to reduce the ridge contact with the cartridge and further retard direct heat transfer to the sleeve body. In a second embodiment, the sleeve, which may or may not include external fins, is provided with a non-heat conducting liner, such as a tubular $Al_2O_3$ liner, for retarding the rate of heat conduction. Finally, a cylindrical screen liner may produce the desired reduction in the rate of heat transfer and the screen may in turn be coated with a heat resistant material such as $Al_2O_3$.

DESCRIPTION OF THE PREFERRED EMBODIMENT

Figure 1:
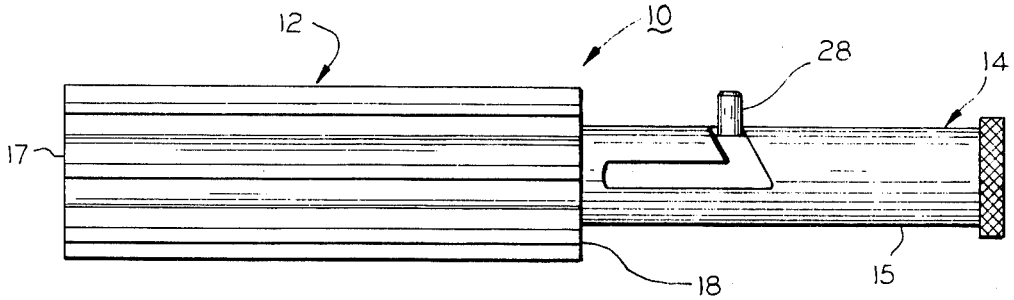
FIG. 1 is a side view showing a sleeve and ignition device according to a preferred embodiment of the present invention, and showing the firing pin in a cocked position.
Figure 2:
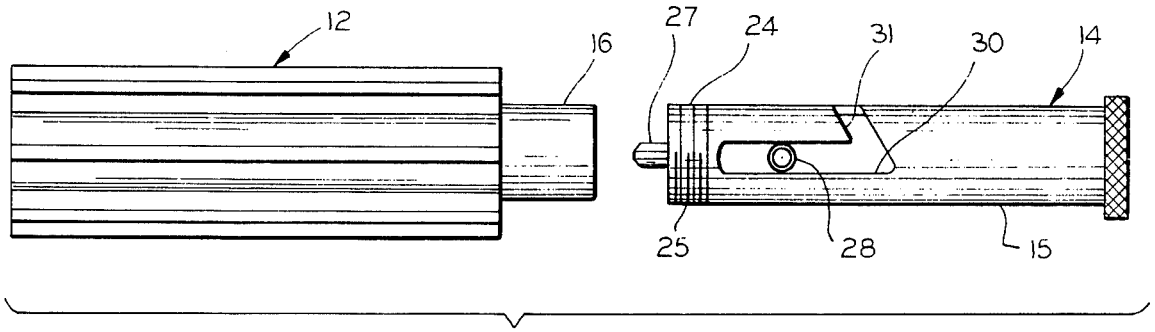
FIG. 2 is a disassembled side view showing the sleeve, heating cartridge and ignition components of a preferred embodiment of the present invention with the firing pin in the release position.

FIG. 1 illustrates a heating device 10 according to the present invention to include a sleeve 12 and a firing pin unit 14 releasably secured thereto. Contained within sleeve 12, and partially removed and visible in FIG. 2, is a heating cartridge 16 which contains a quantity of chemicals which produce heat but substantially no gas upon ignition.

Sleeve 12 is a hollow member having a tubular wall 13 and is closed at a first end 17 and open at its other end 18 for receiving cartridge 16 and then engaging the firing pin unit 14. Sleeve 12 functions to conduct heat from heating cartridge 16 to the substance to be heated and, accordingly, is constructed from a heat conductive material such as aluminum, copper, stainless steel or other non-oxidizing metal. Sleeve 12 may also be constructed from non-metallic materials such as clay or porcelain.

For maximum heat conductivity between cartridge 16 and the substance to be heated, sleeve 12 is shown to include a plurality of fins 19 which run longitudinally from end 17 to end 18 of sleeve 12 and radiate outwardly from the axis of sleeve 12. In the disclosed embodiment there are eight such fins disposed at 45° angles around such axis. Additional configurations for sleeve 12 will become evident after the entire disclosure has been read, and one skilled in the art can readily select an external sleeve design which is suitable for each particular heating job. For example, instead of using fins 19, fins which are transverse to the axis of the cylindrical sleeve may be employed. Also, sleeve 12 may be coated with a material which is easily cleanable to facilitate reuse of sleeve 12 in cooking applications. "Teflon" and ceramic are suitable, as are other materials known to the "non-stick cooking" art.

The internal surface of wall 13 adjacent end 18 is threaded for receivably engaging threads 24 at end 25 of the firing pin unit 14. Of course, other attachment means may be employed for securing the firing pin mechanism to sleeve 12 in a gas tight manner. In the disclosed embodiment, firing pin unit 14 includes a hollow tubular body 15 for containing a spring-loaded firing pin 27 and a trigger catch pin 28. A spring (not shown) forces the firing pin to the position shown in FIG. 2 against a firing pin seat (also not shown) which closes end 25 except for a small hole in its middle. By retracting trigger catch pin 28 along slot 30 which runs longitudinally of the axis of firing pin unit 14, the firing pin 27 is retracted through the firing pin seat into body 15. Trigger catch pin 18 can be locked in the ready position, for example by sliding it into an angular portion 31 of slot 30. The firing pin unit has not been described in great detail because such units, in and of themselves, are well-known. For example, reference is made to U.S. Pat. No. 1,826,562 issued to Minto on Oct. 6, 1931 for a "Gas Gun."

Firing pin unit 14 may be constructed of any suitable material, but since relatively large amounts of heat are generated within sleeve 12 it is desired to construct firing pin unit 14 in such a manner that the external temperature thereof is minimized to allow the user of the device 10 to safely handle it.

The ignition system shown in the FIGS. is only illustrative of many types of ignition systems which may be used for chemical heaters, others of which include electrical and chemical ignition systems, all of which are within the scope of the present invention.

The heating cartridge shown in FIG. 2 includes a cylindrical shell 15 closed at its end within sleeve 12 and closed at its opposite end by a percussion primer cap 37. The percussion primer caps are commercially available and form no part of the present invention. Illustrative primers useful in the present invention are the small arm primers manufactured by any of the well-known munition manufacturers in the United States. In a preferred form, cartridge 16 is constructed from a steel tube approximately 3 inches in length, 0.625 inches in diameter and with a wall thickness of approximately 0.050 inches. Series 1020 steel and 302 or 303 stainless steels are suitable for constructing the cartridges, but other high temperature resistant materials may be employed. Great strength is not a prerequisite for the shell of cartridge 16 as little gas is produced during the reaction.

Turning next to the chemicals to be used in heating cartridge 16, it has been found that the preferred reaction mixture when considering cost, toxicity, heat output and safety is a mixture of aluminum, iron oxide and one or more suitable retardants. As mentioned previously, this reaction mixture is preferred because of its high heat output and because the reaction can be carried out in a closed environment. The iron oxide to be used may be either $Fe_2O_3$ or $Fe_3O_4$ and the preferred chemical mixture is selected from those comprising approximately 0.75 to 1.25 parts-by-weight aluminum, approximately 1.50–3.50 parts-by-weight of one of the iron oxides and between 0.25 and 2.50 parts-by-weight of a suitable retardant such as a 1 to 2 to ½ mixture of these components. The reaction rate and heat output can be widely altered by varying the stoichiometry within these ranges. Anhydrous chemicals, or as nearly anhydrous as practical from a cost standpoint, are employed. The retardant or diluent may be selected from such materials as silica, sand, aluminun-oxide, MgO, $TiO_2$, etc.

The described mixture is compressed within cartridge 16 at pressures ranging from 500–15,000 psi or more to yield a tightly compressed slug which generates little gas on ignition and burning.

Expressly incorporated herein by reference from the aforementioned copending application is that portion of the application relating to means for thermally retarding the reaction of the thermite within cartridge 16. Such means comprises either providing an inert core of diluent material at the center of the reactive slug or dividing the reactive slug into a plurality of compartments using non-reactive vanes and igniting one of the compartments at a time to prolong the reaction, decrease the external cartridge temperature and increase heat transfer efficiency. Such modifications are likewise deemed to be within the scope of the present invention.

Figure 3:
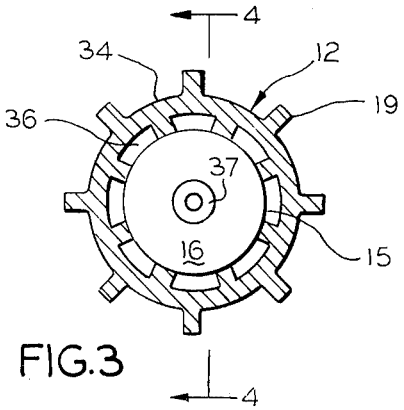
FIG. 3 is an end view of one form of sleeve and containing a heating cartridge.
Figure 4:
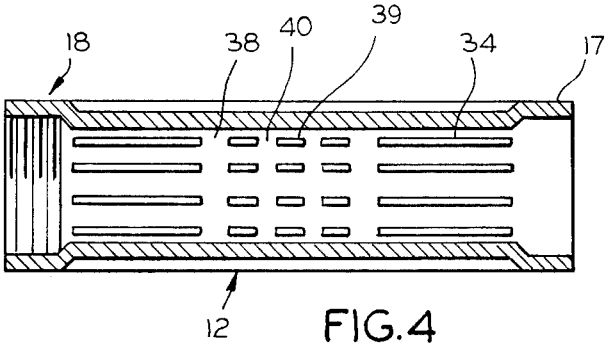
FIG. 4 is a longitudinal section of the sleeve shown in FIG. 3, taken along the line 4—4 of FIG. 3.

FIGS. 3 and 4 show one preferred form of sleeve 12 to include, in addition to external fin 19, a plurality of ridges 34 longitudinally disposed on the interior surface of the sleeve 12. The ridges 34 are constructed and arranged to contact cartridge 16 when it is inserted into the sleeve, but the fit should not be snug, so as to avoid sleeve or cartridge rupture due to differences in the coefficients of thermal expansion of the cartridge and sleeve. In the illustrated embodiment there are eight such ridges, also arranged at 45° angles around the interior surface of sleeve 12, but offset 45° from the external fins. Intermediate adjoining ridges 34 an air space 36 is formed between cartridge 16 and sleeve 12. Any different number of such ridges can be employed and still be within the scope of the present invention. Such ridges need not be disposed between the external fins, and in fact, by using ridges 34 according to the present invention fins 19 may be eliminated for some heating jobs. The preferred form of the invention, however, includes both ridges 34 and fins 19 for obtaining optimum heating efficiency using the above described chemical mixture. The invention has special practicality over prior art devices for heating milk, cocoa or milk-based soups where scorching has been a problem. Ridges 34 can be formed in any suitable manner such as by milling or casting the sleeve 12 or by drawing the finished sleeve through suitable forming dies.

Upon ignition of cartridge 16, the chemical reaction burns from end 18 towards end 17 within the sleeve and a first portion of the resulting heat is conducted directly through ridges 34 to the body of sleeve 12 and finally to fins 19 for being dispersed to the surrounding environment. Heat also travels longitudinally in ridges 34 in both directions during the burn. Air spaces 36 serve to distribute the heat produced in any burning cross-section of the cartridge 16 to the entire surface of sleeve 12 and to retard the rate of heat conduction.

As noted previously, most problems encountered in using sleeves of this type for chemical heaters have been scorching or burning at the mid-point of the sleeve. To solve this problem, the present invention also comprises providing a plurality of interruptions 38 of ridges 34 at the middle portion of sleeve 12. Such interruptions divide the ridges 34 into a plurality of cartridge contact portions 39, separated by air spaces 40 which further retard direct heat conduction at this location.

EXAMPLE I

A 24 gram quantity of a 1–2–½ mixture of aluminum, ferric-oxide and a retardant according to the chemical specifications given herein was packed at 3,000 lbs. pressure into a ½ × 3 × 0.050 inches cartridge which was in turn placed in a stainless steel sleeve such as is shown in FIGS. 1–3 of the copending application, Ser. No. 545,206. The combination was then submerged in 10 oz. milk-based soup (cream of mushroom) at an initial temperature −6° C. Upon ignition of the cartridge the soup was heated to 60° C. during a period of 3½ minutes. The surface of the sleeve was observed during the heating test and it was found that bubbles were formed around that portion of the sleeve adjoining the reacting chemicals within the cartridge. It was also observed that boiling occurred most heavilyu around the middle of the sleeve. Upon removing the sleeve from the milk-based soup, some scorching was noticed.

EXAMPLE II

The above experiment was repeated except that the sleeve was replaced with a sleeve prepared in accordance with the teachings of FIGS. 3–4. The sleeve included eight, spaced ridges longitudinally disposed on the inner surface of the sleeve and interruptions in the ridges at the middle portion of the sleeve. When this combination was immersed and ignited in the same milk-based soup, bubbling occurred over the entire surface of the sleeve and no scorching of the soup was noticed after completion of the heating operation.

Figure 6:
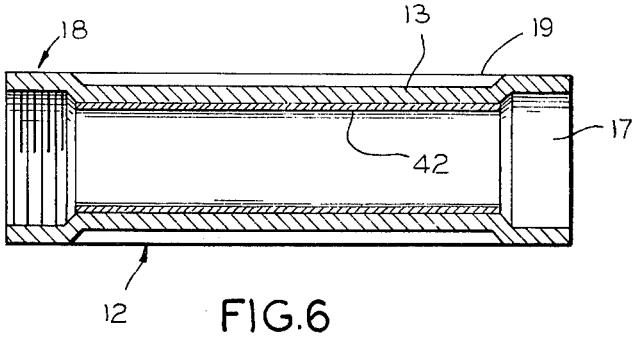
FIG. 6 is a longitudinal section of the sleeve shown in FIG. 5.
Figure 5:
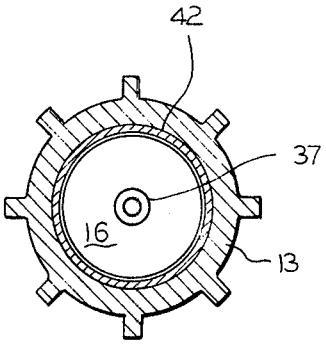
FIG. 5 is an end view of another form of sleeve useful in the present invention and containing a heating cartridge.

A second embodiment of sleeve 12 according to the present invention is illustrated in FIGS. 5–6. In this embodiment, the internal sleeve ridges are replaced with a non-heat conducting liner 42 for sleeve 12. The liner 42 is a cylindrical tube adapted to be snugly inserted into sleeve 12, the outside diameter of liner 42 being substantially equal to the inside diameter of sleeve 12 and the inside diameter of liner 42 being slightly greater than the outside diameter of cartridge 15. Liner 42 preferably is equal in length to cartridge 15. The liner 42 may be between approximately 0.010–0.030 inches in thickness and may be prepared from numerous materials, e.g., $Al_2O_3$ cement, ceramic, plaster or Vycor (a trademark of the Corning Glass Company) and the like. Liner 42 must have a melting point higher than the maximum temperature of cartridge 15 during chemical burn and should desirably have a coefficient of thermal expansion on the order of $10^{-6}$ to $10^{-7}$, and should be resistant to mechanical shock.

Liner 42 acts much the same as internal ridges 34 of FIGS. 3–4 in that it decreases the rate of heat conduction from cartridge 15 to the external surface of sleeve 12. Measurements have established this reduction of external sleeve temperature as well as an increase in the effective heating time for heating device 10.

Figure 7:
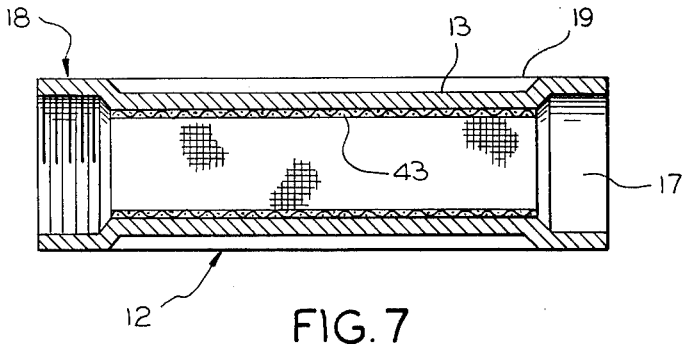
FIG. 7 is an end view of another embodiment of the present invention wherein a screen is interposed between the heating cartridge and sleeve.
Figure 8:
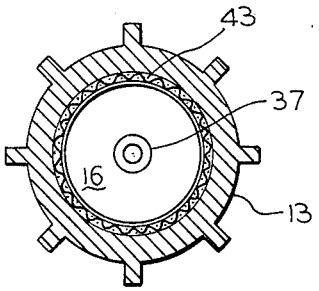
FIG. 8 is a longitudinal section of the embodiment shown in FIG. 7.

A further embodiment of the invention includes using a screen liner 43 (FIGS. 7–8) for sleeve 12, which screen may be of the interwoven or expanded screen variety. The screen liner is shaped similarly to the solid liner and may include one or more layers of the screening material. The screen functions much in the same way as the ridges described above in that the air spaces of the screen openings retard direct heat conduction. In a preferred form of this embodiment the screen itself may be coated with a temperature resistant material such as $Al_2O_3$, cement, plaster, ceramic and the like. The coating may be applied from a slurry and the coated screen dried before it is inserted in sleeve 12. The coated sleeve embodiment may be preferable to the solid tubular lining embodiment because the coated screen is better able to resist mechanical shock.

Numerous variations will occur to those skilled in the art stemming from the disclosure of the present invention. For example, the arrangement and form of the ridges within sleeve 12 can be varied in numerous ways. Moreover, any number of interruptions 38 can be provided at the middle portion of sleeve 12. A wide variety of materials can be chosen for line 42, the screen liner and the coating materials used with screen liners. The invention is not to be limited to those sleeves which have external fins or to the use of the specific chemical heating cartridges disclosed herein. The teachings of the instant invention are adaptable to any heat source disposed in sleeve 12 and where the even distribution of heat therefrom is desirable. So, while the invention has been described in connection with a particular embodiment, the invention is not to be limited thereby but is to be limited solely by the claims which follow.

We claim:

1. A device for transferring heat from a heat source disposed at the interior thereof to the surrounding environment, said device comprising:

means defining an elongate, hollow thermo-conductive body, said body being open at a first portion for insertion of said heat source therein, a heat source within said body, means for supporting the heat source within said body, said supporting means defining a plurality of air spaces between said heat source and said body means and comprising a screen interposed between said heat source and said body means, and said supporting means being adapted for conducting heat from said heat source to the exterior of said body, said air spaces retarding the rate of such heat conduction.

2. In combination, a heating device comprising:

a chemical heat source comprising a hermetically sealed cartridge containing a quantity of a reactive chemical mixture which when ignited generates heat without substantial production of gas, means for igniting said chemical mixture, and sleeve means surrounding said cartridge for transferring heat therefrom to the surrounding environment, said sleeve comprising:

i. a thermo-conductive body constructed and arranged for surrounding said cartridge and being open at a first portion for permitting insertion of the cartridge therein, and ii. means within said body for supporting said cartridge and conducting heat from said cartridge to the exterior of said body, said supporting means comprising a screen interposed between said cartridge and said body for defining a plurality of air spaces intermediate said cartridge and said body for retarding said rate of heat conduction.

3. The invention as set forth in claim 1 wherein said supporting means comprises at least two layers of screen interposed between said heat source and said body means.

4. The invention set forth in claim 1 wherein said screen is coated with a temperature resistant, non-heat conducting material.

5. The invention set forth in claim 2 wherein said supporting means comprises at least two layers of screen interposed between said heat source and said body means.

6. The invention as set forth in claim 2 wherein said screen is coated with a temperature resistant, non-heat conducting material.

* * * * *